United States Patent [19]

Bouza

[11] 4,164,903

[45] Aug. 21, 1979

[54] SHOTGUN WAD FOR USE AS A PRACTICE PROJECTILE

[76] Inventor: Gordon F. Bouza, 4433 Castlebar, Boise, Id. 83703

[21] Appl. No.: 831,594

[22] Filed: Sep. 8, 1977

[51] Int. Cl.[2] ..... F42B 5/22

[52] U.S. Cl. ..... 102/41; 102/92.7; 102/95

[58] Field of Search ..... 102/41, 42 C, 92.7, 102/95

[56] References Cited

U.S. PATENT DOCUMENTS

| | | | |
|---|---|---|---|
| 157,793 | 12/1874 | Cochran | 102/42 C |
| 3,911,824 | 10/1975 | Barr et al. | 102/92.7 |

FOREIGN PATENT DOCUMENTS

| | | | |
|---|---|---|---|
| 1548296 | 10/1968 | France | 102/42 C |
| 578716 | 7/1958 | Italy | 102/42 C |

*Primary Examiner*—Verlin R. Pendegrass
*Assistant Examiner*—Edward F. Miles
*Attorney, Agent, or Firm*—Fitch, Even & Tabin

[57] ABSTRACT

A novel shotgun wad is disclosed for use in a practice cartridge which includes a conventional tubular casing having a closed end and an open opposite end, the wad having a first cup portion facing a detonable primer charge at the closed end of the casing, and having a second cup portion facing the open end of the casing and defining a rounded aerodynamic flight end. Upon detonation of the primer charge, the wad is projected outwardly from the casing with the rounded flight end thereof facilitating a truer flight trajectory than obtainable without the rounded end.

10 Claims, 5 Drawing Figures

Fig. 1.
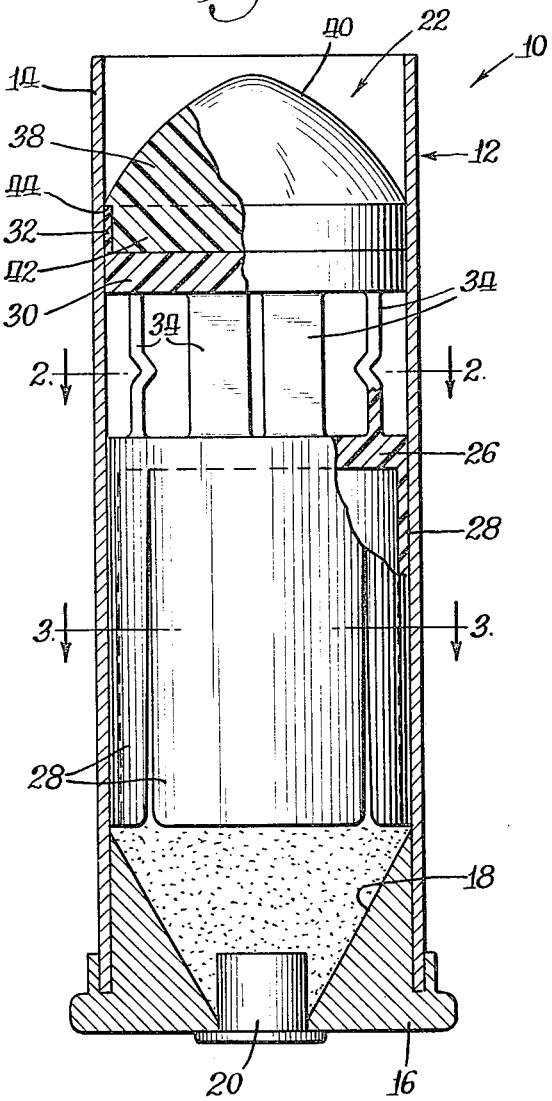
Fig. 2.
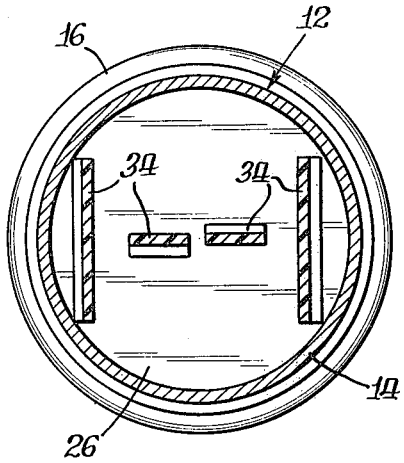
Fig. 3.
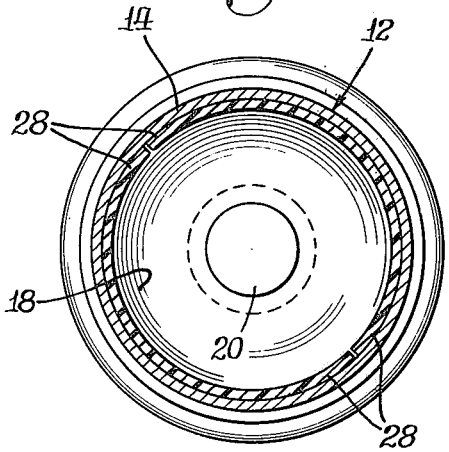
Fig. 4.
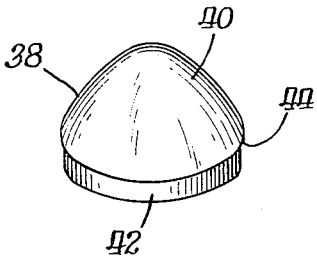
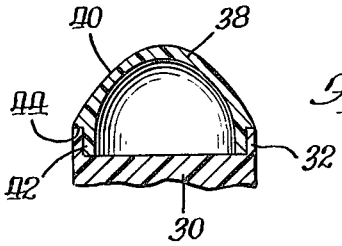
Fig. 5.

SHOTGUN WAD FOR USE AS A PRACTICE PROJECTILE

The present invention relates generally to practice cartridges or shells, and more particularly to a novel inexpensive wad for use in a practice shotgun cartridge wherein the wad is inserted into a tubular closed end casing in a position inverted from its normal usage, the wad having a rounded flight end formed thereon which facilitates projection of the wad through a truer trajectory during practice shooting than has heretofore been obtainable with wad projectiles.

It is common for hunters and other sportsmen who use shotguns to practice shooting with practice shells to improve their shooting competence. Numerous types of practice shells are known which, for the most part, employ a separate projectile or slug assembled within the shell casing in a manner to retain a primer and/or secondary charge of propellant which, when detonated, effects projection of the projectile or slug from the shell casing. Practice shells are known in which a projectile is retained within a shell casing and is provided with a rounded outer end. See, for example, U.S. Pat. No. 3,361,066 to Gawlick et al., dated Jan. 2, 1968 and U.S. Pat. No. 1,902,771 to Gaivos, dated Mar. 21, 1933. The practice shells disclosed in these United States patents, however, are relatively expensive.

The present invention is concerned with the provision of an improved inexpensive wad which may be employed in a practice shell as the practice projectile, the wad being disposed within the shell casing in a position generally inverted from its normal usage and having a pointed or rounded end formed thereon to facilitate projection through a truer trajectory than has heretofore been possible with wads used as projectiles in practice shotgun shells.

In carrying out the present invention, a conventional shotgun wad of the type having a cup portion normally adapted to contain a charge within a shell casing and having a cup portion normally adapted to contain shot is inserted into the shell casing in a position inverted from its normal usage. The normal charge containing cup portion is formed with a rounded or pointed end which provides an aerodynamic flight end facing in the direction of the open end of the cartridge shell, while the normal shot-containing cup portion faces the closed end of the cartridge shell and an associated internal primer. Detonation of the primer effects projection of the wad which, because of its rounded flight end, travels through a truer trajectory than has heretofore been possible with wad projectiles.

The various objects and advantages of the present invention, together with the organization and manner of operation thereof, will become apparent from the following detailed description of the invention when taken in conjunction with the accompanying drawing wherein like reference numerals designate like elements throughout the several views, and wherein:

FIG. 1 is a fragmentary longitudinal sectional view of a practice shotgun shell or cartridge employing a wad projectile in accordance with the present invention;

FIG. 2 is an enlarged transverse sectional view taken substantially along the line 2—2 of FIG. 1, looking in the direction of the arrows;

FIG. 3 is an enlarged transverse sectional view taken substantially along the line 3—3 of FIG. 1, looking in the direction of the arrows;

FIG. 4 is a perspective view of the flight end employed on the wad of FIG. 1; and FIG. 5 is a fragmentary longitudinal sectional view illustrating an alternative hollow flight end for the practice wad.

Referring now to the drawing, a practice shotgun shell or cartridge employing a novel wad in accordance with the present invention is indicated generally at 10. The practice shotgun shell or cartridge 10 is particularly suitable for indoor practice shooting and includes a conventional tubular casing 12 having a cylindrical tubular wall 14 open at one end and closed at its other end by a base 16 suitably secured to the base end of the casing in a known manner. Conventionally, the cylindrical tubular wall 14 is made of a paper fiber material and the base 16 is made of a suitable metallic material. The cylindrical tubular wall 14 and base 16 may be made of different sizes to facilitate usage of the practice shell with shotguns of different gauge size.

The base 16 has a frustoconical interior surface 18 disposed circumferentially of a cylindrically shaped primer 20 of known design. The primer 20 is secured within a suitable opening in the base 16 so as to have an outer surface exposed for engagement with the firing pin of a shotgun to effect detonation of the primer. In conventional shotgun cartridges, the primer 20 serves to effect detonation of a secondary charge disposed within the cavity defined by the frustoconical surface 18. It is the latter detonation that effects propulsion of the shot from conventional shotgun shells.

The practice shell 10 includes a wad indicated generally at 22, which is preferably made of a suitable plastic and is retained within the tubular casing 12 and serves as the practice projectile to be shot from the shell casing. The wad 22 includes a first cup portion defined by a generally planar circular end wall 26 having a plurality of longitudinally extending fingers 28 formed integral therewith. In the illustrated embodiment, four fingers 28 are formed integral with the end wall 26 and each finger has an arcuate transverse configuration subtending an arc of approximately 90° so that the four fingers are separated by longitudinal slits facilitating flexure of the fingers. The diameter of the end wall 26 is of a size suitable to effect engagement of its circumferential edge surface with the interior surface of the tubular wall 14 of casing 12.

The wad 22 has a second cup portion defined by a generally planar circular wall 30 having an upstanding annular rim 32 formed integral therewith about the circumferential edge of the planar wall 30. The circular walls 26 and 30 are connected in parallel relation through a collapsible connection in the form of a plurality of connecting elements 34 formed integral with the walls 26 and 30. The connecting elements 34 are of conventional design and, in normal usage of the wad, are adapted to collapse during ignition of the charge so as to reduce the "kick" of the shotgun during firing.

As thus far described, the wad 22 is of generally known design. In conventional use, the wad is inserted within the shell casing 12 with the cup portion defined by the wall 30 and integral rim 32 facing the closed end of the shell and the primer 20. In this position, the wall 30 and rim 32 retain a detonable charge which is ignited by the primer 20 upon impact by a firing pin. With the wad 22 thus positioned, the fingers 28 extend longitudinally of the shotgun casing in the direction of the open end thereof and, with the end wall 26, serve to retain shot which is expelled with the wad from the shotgun shell during firing.

In accordance with the present invention, the wad 22 is inserted into the shell casing 14 in a position inverted from the aforedescribed position, as best seen in FIG. 1. In this position, the cup portion defined by the end wall 26 and fingers 28 faces the closed end of the shell casing, and the cup portion defined by the circular wall 30 and integral rim 32 faces the open end of the shell. The wad 22 is provided with a rounded or pointed flight end cap 38 which is preferably made of a suitable plastic material. The flight end 38 has an external surface 40 symmetrical about the longitudinal axis of the wad 22 and preferably generally conically shaped to define an aerodynamic air flow surface which minimizes air drag on the wad as would occur during flight of the wad if it had a flat blunt windward end. The flight end 38 has a cylindrical base end 42 formed thereon having a peripheral surface of a diameter to be snugly received within the annular rim 32. An annular shoulder surface 44 engages the outer edge surface of the rim 32 so that the external surface 40 on the flight end is contiguous to the outer surface of the annular rim 32.

The flight end 38 may be formed separate from the wad 22 and of suitable size to be snugly received within the annular rim 32 to engage the planar wall 30, or may be formed integral with the end of the wad 22 defined by wall 30 and rim 32. If formed separate, an adhesive is preferably applied between the rim 32 and cylindrical base 42 on the flight end 38, and/or between the wall 30 and opposing surface of the flight end. The rounded flight end 38 may be solid, as shown in FIG. 1, or hollow, as shown in FIG. 5.

In briefly reviewing the operation of the practice shell 10, it will be appreciated that when the shell is inserted within a shotgun and the firing pin of the shotgun activated to impact the primer 20, the ensuing explosion will effect outward projection of the wad 22 from the casing 12. The rounded flight end 38 on the wad facilitates a "true" flight trajectory of the wad through the air; that is, a trajectory dependent for the most part upon the initial velocity imparted to the wad and the action of gravity acting on the mass of the wad. Air drag and air pressure forces which would otherwise act on the forward blunt surface 30 of the wad projectile, in the absence of the flight end 38, are virtually eliminated by the aerodynamic surface 40 on the flight end cap. A detonable pressure producing charge in addition to the primer 20 need not be provided within the chamber internally of the frustoconical surface 18 to effect the desired projection of the wad 22.

Thus, in accordance with the present invention, a practice shotgun shell and associated inexpensive wad projectile are provided wherein the wad may be readily produced either as an article of original manufacture or from existing type wads by the addition of the rounded flight end 38 as aforedescribed. The wad 22 in accordance with the invention facilitates home loading into a shotgun shell casing for practice shooting.

While a preferred embodiment of the present invention has been illustrated and described, it will be understood to those skilled in the art that changes and modifications may be made therein without departing from the invention in its broader aspects. Various features of the invention are defined in the following claims.

What is claimed is:

1. An ammunition cartridge for practice shooting comprising a tubular casing of predetermined longitudinal length having a closed end and an opposite open end, a detonable primer disposed adjacent said closed end, a wad disposed within said casing and adapted to be projected therefrom, and a charge disposed between said wad and said closed end of said casing so that detonation of said primer effects projection of said wad from said casing, said wad having a first cup portion defined by a plurality of longitudinal fingers extending in the direction of said closed end of said casing, said wad having a second cup portion including a base end wall connected to said first cup portion and having a circumferential edge adapted to engage the internal surface of said tubular casing, said base end wall including a flight end facing said open end of said cartridge and defined by a generally conical surface establishing an axially outwardly projecting aerodynamic air flow surface on said wad to facilitate flight thereof, said wad having a longitudinal length such that said wad is disposed substantially fully within said tubular casing, detonation of said primer being operative to effect projection of said wad outwardly of said open end of said casing with said wad maintaining its structural integrity throughout flight thereof.

2. The improvement as defined in claim 1 wherein said second cup portion includes an annular wall the outer peripheral surface of which is adapted to engage the interior surface of said tubular casing, said annular wall defining with said base end wall a recess, said rounded flight end having a portion received and retained within said recess and extending outwardly therefrom to define a generally conical aerodynamic air flow surface on the forward end of said wad.

3. The improvement as defined in claim 1 wherein said rounded flight end is substantially hollow.

4. The improvement as defined in claim 1 wherein said rounded flight end forming said aerodynamic air flow surface is formed from a solid generally pointed member.

5. The practice cartridge as defined in claim 4 wherein said wad and said rounded flight end are formed of plastic.

6. A wad for use in a practice shotgun cartridge having a tubular casing of predetermined longitudinal length with a closed end and an open opposite end, said wad including a first cup portion normally adapted to contain a shot loading and having a second cup portion normally adapted to contain a charge, said wad having a generally conically shaped flight end on second cup portion extending axially outwardly thereof in a direction opposite to said first cup portion to facilitate insertion of said wad into a cartridge casing with said first cup portion facing the closed end of said cartridge casing, said first cup portion including a plurality of longitudinal fingers extending in a direction opposite to said flight end, said wad having a longitudinal length such that said wad may be substantially fully received within said tubular casing with said flight end facing the open end of said cartridge case to facilitate projection of said wad from said cartridge casing with said generally conically shaped flight end thereof defining an aerodynamic flight surface for said wad.

7. A wad as defined in claim 6 wherein said generally pointed flight end on said second cup portion comprises a separate flight end cap secured to said second cup portion in axial alignment therewith.

8. A wad as defined in claim 6 wherein said flight end is solid.

9. A wad as defined in claim 6 wherein said flight end is hollow.

10. A wad as defined in claim 7 wherein said separate flight end is formed of plastic.

* * * * *